US005226195A

United States Patent [19]

Pappas, Jr.

[11] Patent Number: 5,226,195

[45] Date of Patent: Jul. 13, 1993

[54] COMBINATION TOOL AND APPARELL BELT

[76] Inventor: George A. Pappas, Jr., 671 E. Normandy Blvd., Deltona, Fla. 32725

[21] Appl. No.: 647,641

[22] Filed: Jan. 25, 1991

[51] Int. Cl.[5] ..... A41F 9/00

[52] U.S. Cl. ..... 2/338; 2/321; 2/322; 224/904

[58] Field of Search ..... 2/2, 44, 92, 300, 310, 2/311, 312, 321, 322, 338; 224/904

[56] References Cited

U.S. PATENT DOCUMENTS

| | | | |
|---|---|---|---|
| 689,352 | 12/1901 | Buffington | 2/338 |
| 732,289 | 6/1903 | Fischman | 2/338 |
| 1,597,508 | 8/1926 | Brenner | 2/338 |
| 1,774,222 | 8/1930 | Bermejo et al. | 2/338 |
| 2,514,796 | 7/1950 | Rishcoff | 2/338 |
| 4,726,077 | 2/1988 | Batiste | 2/338 X |
| 4,790,461 | 12/1988 | Stover | 224/904 X |
| 4,802,667 | 2/1989 | Altner | 2/338 X |
| 4,836,194 | 6/1989 | Sebastian et al. | 2/DIG. 6 X |
| 4,849,863 | 7/1989 | Gallegos | 2/238 X |
| 4,953,767 | 9/1990 | Bennett | 224/904 X |
| 4,993,614 | 2/1991 | Bonofiglo | 224/904 X |

*Primary Examiner*—Clifford D. Crowder
*Assistant Examiner*—Jeanette E. Chapman

[57] ABSTRACT

A combination tool and apparel belt for carrying tools and maintaining a wearer's trousers. The belt comprises a main belt member, a lower tool belt member, an upper apparel belt member. The tool and apparel belt members both emerge from two end sections of the main belt member. The tool and apparel belt members secure around the user's waist by buckle and hole fastening means. The apparel belt member is adapted to be threaded through the trouser loops of a wearer and the tool belt member carriers tools.

1 Claim, 1 Drawing Sheet

COMBINATION TOOL AND APPARELL BELT

BACKGROUND OF THE INVENTION

1. Field of the Invention

This invention relates generally to belts and more particularly apparel and tool belts.

2. Prior Art

People who carry tools to perform their task usually employ a single belt, a pouch attached to that belt and tools inserted into the pouch. The belt is worn around the person's abdominal region, above, below or across their apparel belt. One problem that occurs as a result of this situation is that the person's apparel is pulled in a downward direction causing discomfort and constant attempts to adjust. Another problem is that the belt presses the abdominal region inward, opposite to where the tools are carried also causing discomfort to the wearer. The result of these problems is that the person's apparel is in constant disarray. Pain and discomfort increases proportionately to the length of time worn (the tool belt). Further, the person will normally shed their tools, postponing the completion of their task.

SUMMARY OF THE INVENTION

It is the object of this invention to provide a device which will maintain a person's apparel in a dignified and kept manner and provide a new and improved way to carry objects. Accordingly, the combination tool and apparel belt is provided comprising of an upper elongated member, a lower elongated member, and a means to join together and position said members around the abdomen region in the following way: The upper elongated member engages apparel (most likely belt loops). Adjustment is provided through a buckling means. The lower elongated member is worn below the upper member and engages objects to be carried. Adjustment is again provided through a buckling means. The means provided to join together and position the said members is always positioned on the opposite side the objects are carried.

By joining together and positioning these members in the described fashion, the invention solves a little recognized, yet to this inventor, an obvious problem, producing novel results in view of the prior art, and would be unobvious to one having ordinary skill in the art. That is, providing a means to join together and position these elongated members to engage apparel and objects.

DESCRIPTION OF THE PREFERRED EMBODIMENT

Figure 1:
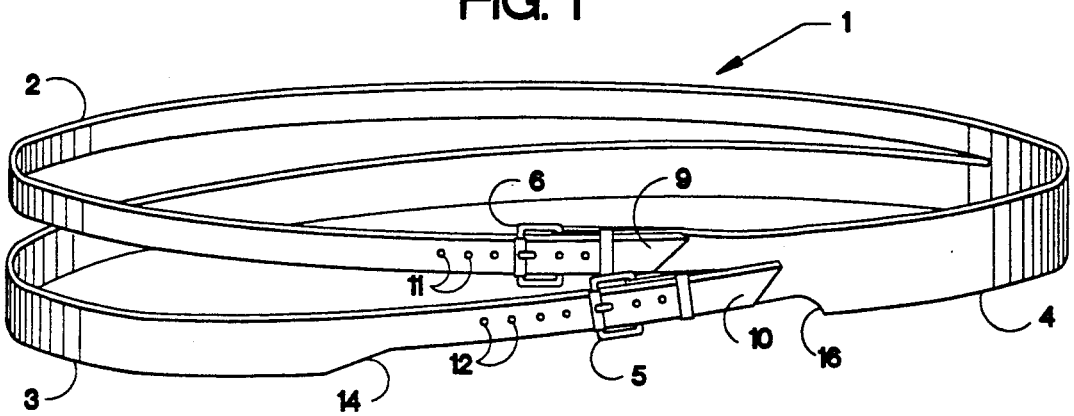
FIG. 1 depicts an isomentric view of the compination tool and apparel belt.
Figure 2:
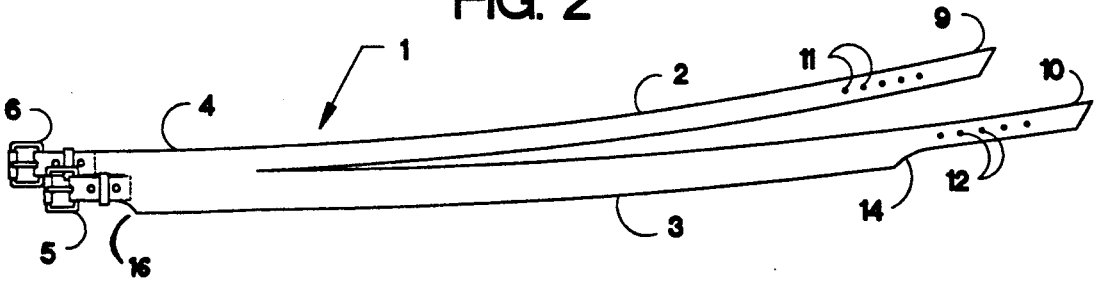
FIG. 2 depicts an inner face view of the compination tool and apparel belt.

As shown in FIG. 1 and FIG. 2 a preferred embodiment of the invention shows a combination tool and apparel belt 1 for carrying tools and maintaining a wearer's trousers comprises a front, rear, left and right side portions. The combination belt also includes an upper elongated apparel belt member 2, a lower elongated tool belt member 3, and a main belt member, 4, having two end sections. The apparel belt member 2 and the tool belt member 3 emerge from one of the end sections toward the front of the belt 1. Belt member 2 has a buckle 6 mounted thereon at an end thereof. Belt member 3 also has a buckle 5 mounted thereon at an end thereof. The apparel belt member 2 and the tool belt member 3 also emerge from the other end section of the main belt member toward the rear portion of the belt 1, encircling the body of the user, and the apparel belt member 2 and the tool belt member 3 each have an end, 9 and 10, with a plurality of holes, 11 and 12, respectively, for engagement with the buckles, 6 and 5. The tool belt member 3 is narrower than the main belt member 4 and the apparel belt member 2 is narrower than the tool belt 3 member in order that it (the belt member 2) may be threaded through trouser loops of a wearer. The tool belt member 3 also includes indented portions 14 forming a narrowed section of the tool belt where the buckle 5 is attached and the holes 12 are formed in order to allow the belt to adapt to the wearer's contour.

THEORY OF OPERATION

The upper elongated apparel belt member engages apparel belt loops and the lower elongated tool belt member engages objects. The main belt member 4 is provided to join together and position the above two member 2 and 3 to enable each members function to enhance the other's; for example the weight of the objects carried on the tool belt helps to maintain the positioning of the apparel and the apparel belt helps to distribute the weight of objects carried by the tool belt. Other embodiments and improvements will occur to those skilled in the art and are intended to be included within the scope and spirit of this disclosure.

I claim:

1. A combination tool and apparel belt for carrying tools and maintaining a wearer's trousers comprising:

a main belt member;

a tool belt member;

an apparel belt member;

the combination belt, in a position of use, having front, rear, left side, and right side portions;

the main belt member positioned at one of said left and right side portions and having two end sections;

the tool belt member emerging from one of said end sections toward the front portion and having a buckle mounted thereon at an end thereof;

the tool belt member also emerging from the other of said end sections toward the rear portion, encircling the body of a wearer, and having a plurality of holes therein at a second end thereof for engagement with said buckle;

the apparel belt member emerging from one of said end sections toward the front portion and having a second buckle mounted thereon at an end thereof above the buckle of the tool belt member;

the apparel belt member also emerging from the other of said end sections toward the rear portion, encircling the body of a user above the tool belt member, and having a plurality of holes therein at a second end thereof for engagement with said second buckle;

wherein the tool belt member is narrower than said main belt member, and wherein the apparel belt member is narrower than said tool belt member whereby it is adapted to be threaded through trouser loops of a wearer;

the tool belt member further including, at a front portion thereof, indented portions forming a narrowed section of the tool belt where the buckle is attached and the holes are formed in order to allow the belt to adapt to the contour of the wearer.

* * * * *